US009622522B2

(12) United States Patent
George

(10) Patent No.: US 9,622,522 B2
(45) Date of Patent: Apr. 18, 2017

(54) GARMENT TRANSFORMABLE BETWEEN A PLURALITY OF CONFIGURATIONS

(71) Applicant: Kristen George, Florissant, MO (US)

(72) Inventor: Kristen George, Florissant, MO (US)

( * ) Notice: Subject to any disclaimer, the term of this patent is extended or adjusted under 35 U.S.C. 154(b) by 111 days.

(21) Appl. No.: 14/676,538

(22) Filed: Apr. 1, 2015

(65) Prior Publication Data

US 2016/0286869 A1 Oct. 6, 2016

(51) Int. Cl.
*A41D 15/00* (2006.01)

(52) U.S. Cl.
CPC ..... *A41D 15/007* (2013.01)

(58) Field of Classification Search
CPC ..... A41D 13/00; A41D 15/00; A41D 15/04; A41D 15/007
USPC ..... 2/69, 129, 144
See application file for complete search history.

(56) References Cited

U.S. PATENT DOCUMENTS

| | | | | |
|---|---|---|---|---|
| 2,575,791 | A | 11/1951 | Brown | |
| 2,598,462 | A | 5/1952 | Strauss | |
| 2,603,788 | A | 7/1952 | Page | |
| 2,656,540 | A | 10/1953 | Stephenson | |
| 2,668,293 | A | 2/1954 | Levy | |
| 3,143,740 | A | 8/1964 | Spiegelberg | |
| 3,144,660 | A | 8/1964 | Portaro | |
| 3,473,167 | A | 10/1969 | Jeffrey | |
| 4,106,125 | A | 8/1978 | Palumbo | |
| 4,142,253 | A | 3/1979 | Roscoe | |
| 4,667,345 | A | 5/1987 | Jachowski | |
| 4,706,304 | A | 11/1987 | Jones | |
| 8,214,923 | B2 | 7/2012 | Lee | |
| 2008/0282444 | A1 | 11/2008 | Lin | |
| 2012/0079644 | A1 | 4/2012 | Benderradji | |
| 2013/0042381 | A1 | 2/2013 | Yonover | |
| 2014/0310851 | A1* | 10/2014 | Jones | A41D 15/00 2/129 |
| 2015/0164162 | A1* | 6/2015 | Tran | A41D 15/00 2/69 |

(Continued)

FOREIGN PATENT DOCUMENTS

| | | | |
|---|---|---|---|
| CN | 202774288 | U | 3/2013 |
| ES | 2024803 | A6 | 3/1992 |

(Continued)

OTHER PUBLICATIONS

"Cosabella Suave Tube", My Fab Fit Forties, Jun. 20, 2013, pp. 1-8, http://www.myfabfitforties.com/2013/06/cosabella-suave-tube-wear-14-ways-79.html.

(Continued)

*Primary Examiner* — Katherine Moran
(74) *Attorney, Agent, or Firm* — Thompson Coburn, LLP; Alan H. Norman

(57) ABSTRACT

A garment transformable among two or more configurations comprising a flexible tube and a fastener mechanism. The flexible tube comprises a tube wall defining first and second openings. The tube wall comprises first and second apertures. The fastener mechanism is adapted to adjustably close at least a portion of the first aperture to vary an effective length of the first aperture. The flexible tube is adapted to be worn by a user in an arm-covering configuration. Preferably, the flexible tube is also adapted to be worn in a scarf configuration, a first dress configuration, a second dress configuration, and a skirt configuration.

20 Claims, 9 Drawing Sheets

(56) References Cited

U.S. PATENT DOCUMENTS

2016/0174621 A1* 6/2016 James ..... A41D 1/04
2/102

FOREIGN PATENT DOCUMENTS

WO 2010/097820 A1 9/2010
WO 2013/025873 A1 2/2013

OTHER PUBLICATIONS

"Elementum Cinco", Elementum, http://www.luxuryistohavesimplethings.com/collections/list?collectionId=2, downloaded Sep. 23, 2014.
"Elementum Dois", Elementum, http://www.luxuryistohavesimplethings.com/collectionstlist?collectionId=2, downloaded Sep. 23, 2014.
"Elementum Meio Double", Elementum, http://www.luxuryistohavesimplethings.com/collections/list?collectionId=2, downloaded Sep. 23, 2014.
"Elementum Quatro", Elementum, http://www.luxuryistohavesimplethings.com/collections/list?collectionId=2, downloaded Sep. 23, 2014.
"Elementum Tres", Elementum, http://www.luxuryistohavesimplethings.com/collections/list?collectionId=2, downloaded Sep. 23, 2014.
"The Versalette", Seamly.Co, pp. 1-4, http://www.seamly.co/pages/the-versalette, downloaded Sep. 23, 2014.

* cited by examiner

GARMENT TRANSFORMABLE BETWEEN A PLURALITY OF CONFIGURATIONS

CROSS-REFERENCE TO RELATED APPLICATIONS

Not applicable.

STATEMENT REGARDING FEDERALLY SPONSORED RESEARCH OR DEVELOPMENT

Not Applicable.

APPENDIX

Not Applicable

BACKGROUND OF THE INVENTION

The field of the invention relates generally to a garment.

SUMMARY OF THE INVENTION

In one aspect of the invention, a garment transformable among two or more configurations comprises a flexible tube and a fastener mechanism. The flexible tube comprises a tube wall extending generally along a longitudinal axis. The tube wall defines first and second openings at opposite first and second ends of the tube. The tube wall comprises first and second apertures. The first aperture has a first maximum length extending generally longitudinally from a first aperture point to a second aperture point. The second aperture has a second maximum length extending from a third aperture point to a fourth aperture point. The first aperture is laterally spaced from the second aperture. At least a portion of the first aperture is located circumferentially opposite a portion of the second aperture. The fastener mechanism is at least partially located between the first aperture and adapted to adjustably close at least a portion of the first aperture to vary an effective length of the first aperture. The flexible tube is adapted to be worn by a user in an arm-covering configuration wherein at least a portion of one arm of the user is in the tube adjacent the first end and at least a portion of another arm of the user is in the tube adjacent the second end.

Figure 1:
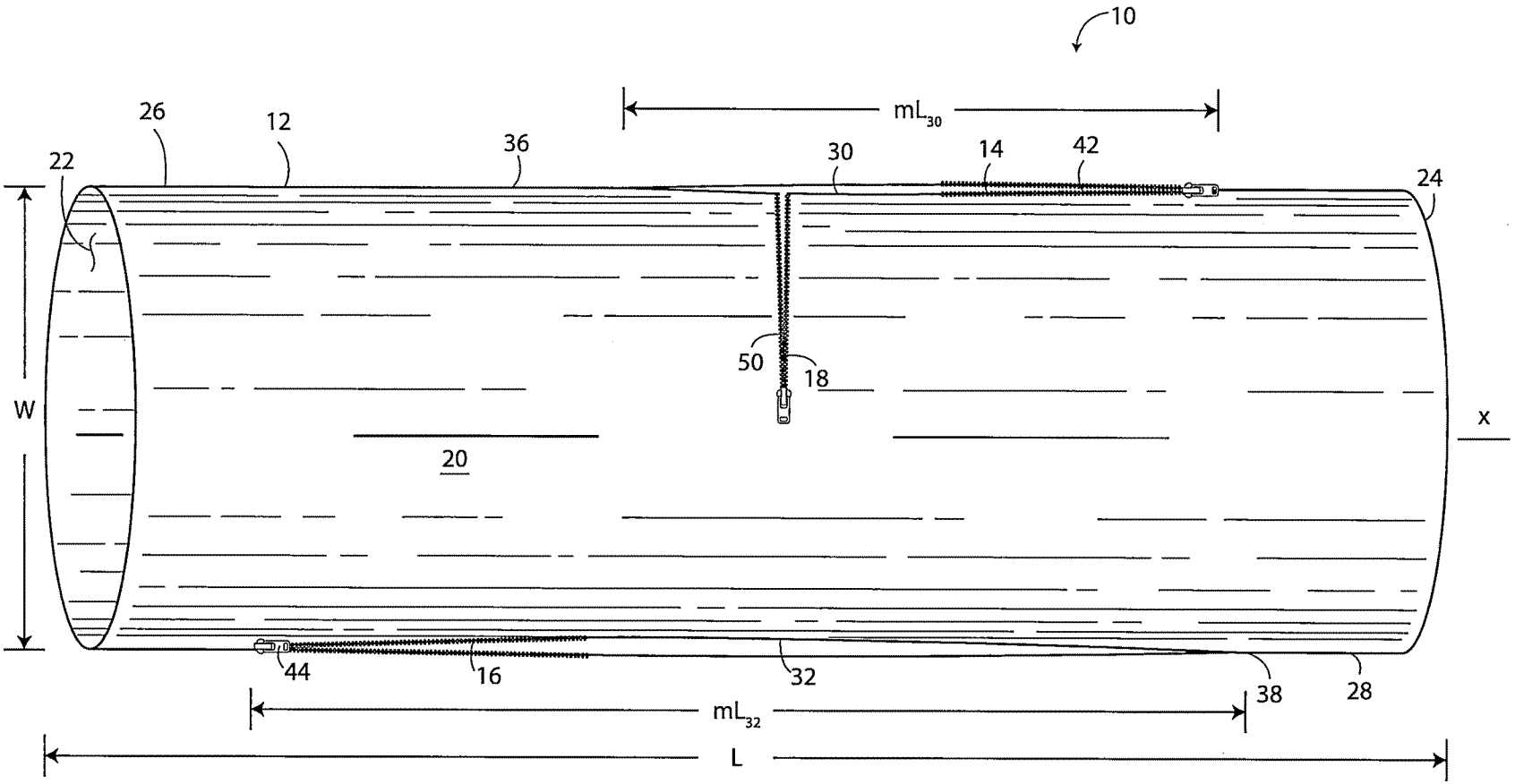
FIG. 1 is an isometric view of an embodiment of a garment transformable among a plurality of configurations.

Reference numerals in the written specification and in the drawing figures indicate corresponding items.

DETAILED DESCRIPTION OF THE EMBODIMENTS

An embodiment of the present invention comprises a garment indicated generally by reference numeral 10. The garment 10 is transformable among any of a plurality of configurations to another of the plurality of configurations. In the embodiment shown in FIGS. 1-2, the garment 10 comprises a flexible tube 12, a first fastener mechanism 14, a second fastener mechanism 16, and a third fastener mechanism 18. The flexible tube 12 can be made of an elastic fabric, a cotton twill fabric, or a knit fabric (e.g., cotton jersey). A person of ordinary skill in the art will understand that other types of fabrics could be used in conjunction with the present invention.

Figure 2:
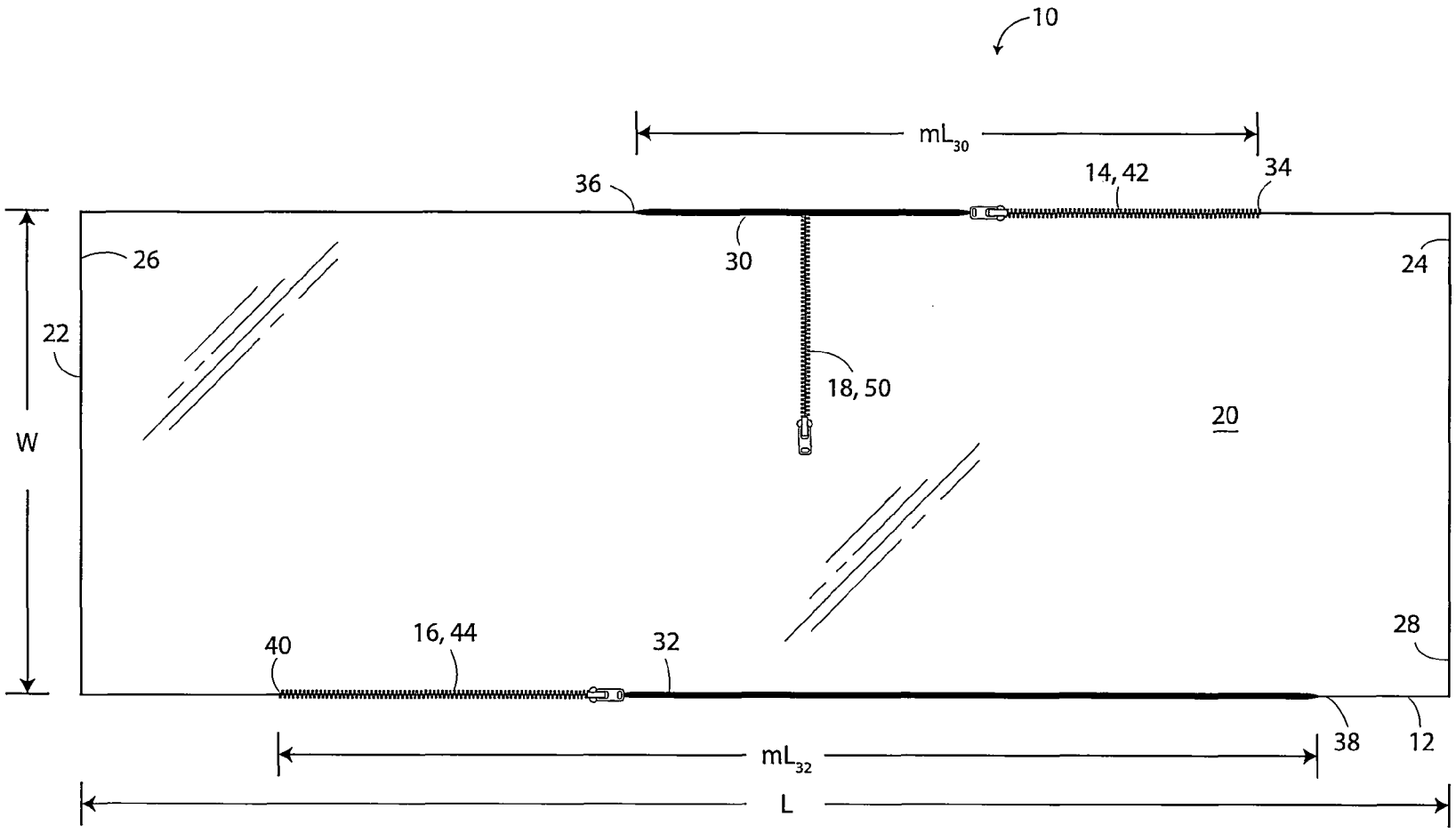
FIG. 2 is a side elevational view of the garment of FIG. 1.

Referring to FIGS. 1-2, the flexible tube 12 of this embodiment extends generally along a longitudinal axis X. The garment 10 has an overall length L and an overall width W. The overall length L generally extends axially along the longitudinal axis X and the overall width W generally extends perpendicular to the longitudinal axis. Preferably, the garment 10 has a ratio of overall length L to overall width W that is greater than 1. More preferably, the garment 10 has a ratio of overall length L to overall width W that is greater than 2.5.

Referring to FIGS. 1-2, the flexible tube 12 comprises a tube wall 20. The tube wall 20 defines a first opening 22 and a second opening 24. The first opening 22 is located at a first end 26 of the flexible tube 12 and the second opening 24 is located at a second end 28 of the flexible tube. The tube wall 20 further comprises a first aperture 30 and a second aperture 32. As shown in FIG. 1, the first aperture 30 has a first maximum length $mL_{30}$ extending from a first aperture point 34 to a second aperture point 36. The second aperture 32 has a second maximum length $mL_{32}$ extending from a third aperture point 38 to a fourth aperture point 40. Preferably, the first maximum length $mL_{30}$ is greater than the second maximum length $mL_{32}$. The first aperture 30 is spaced laterally from the second aperture 32, and at least a portion of the first aperture is located circumferentially opposite a portion of the second aperture. Preferably, an entirety of the first aperture 30 is located circumferentially opposite a portion of the second aperture 32. More preferably, the first and second apertures 30, 32 are slits within the tube wall 20 such that the flexible tube 12 is a zero waste garment. A zero waste garment refers to a sustainable garment in which no fabric is wasted during its production.

The first fastener mechanism 14 is at least partially located between the first and second aperture points 34, 36 respectively. The first fastener mechanism 14 is adapted to adjustably close at least a portion of the first aperture 30 to vary an effective length of the first aperture. The second fastener mechanism 16 is located between the third and fourth aperture points 38, 40 respectively. The second fastener mechanism 16 is adapted to adjustably close at least a portion of the second aperture 32 to vary an effective length of the second aperture. FIG. 1 shows the first and second fastener mechanisms 14, 16, respectively, configured in a manner such that the first aperture 30 is at the first maximum length $mL_{30}$ and the second aperture 32 is at the second maximum length $mL_{32}$. FIG. 2 shows the first and second fastener mechanisms 14, 16, respectively, adjusted such that they are closed, thereby varying the effective length of the first and second apertures 30, 32, respectively. In the embodiment shown in FIGS. 1-2, the first fastener mechanism 14 comprises a first zipper 42 and the second fastener mechanism 16 comprises a second zipper 44. More preferably, the first fastener mechanism 14 extends from the first aperture point 34 towards the second aperture point 36, and the second fastener mechanism 16 extends from the fourth aperture point 40 towards the third aperture point 38. The flexible tube 12 comprises a third fastener mechanism 18. In FIGS. 1-2, the third fastener mechanism 18 comprises a third zipper 50. The third fastener mechanism 18 is located adjacent the first aperture 30 and is adapted to adjustably close a portion of the first aperture to vary an effective width of the first aperture. A person of ordinary skill in the art will understand that additional types of fasteners could be used for the third fastener mechanism 18, including, but not limited to, a button, a plurality of buttons, Velcro, hook and eye fasteners, and snaps.

Figure 3:
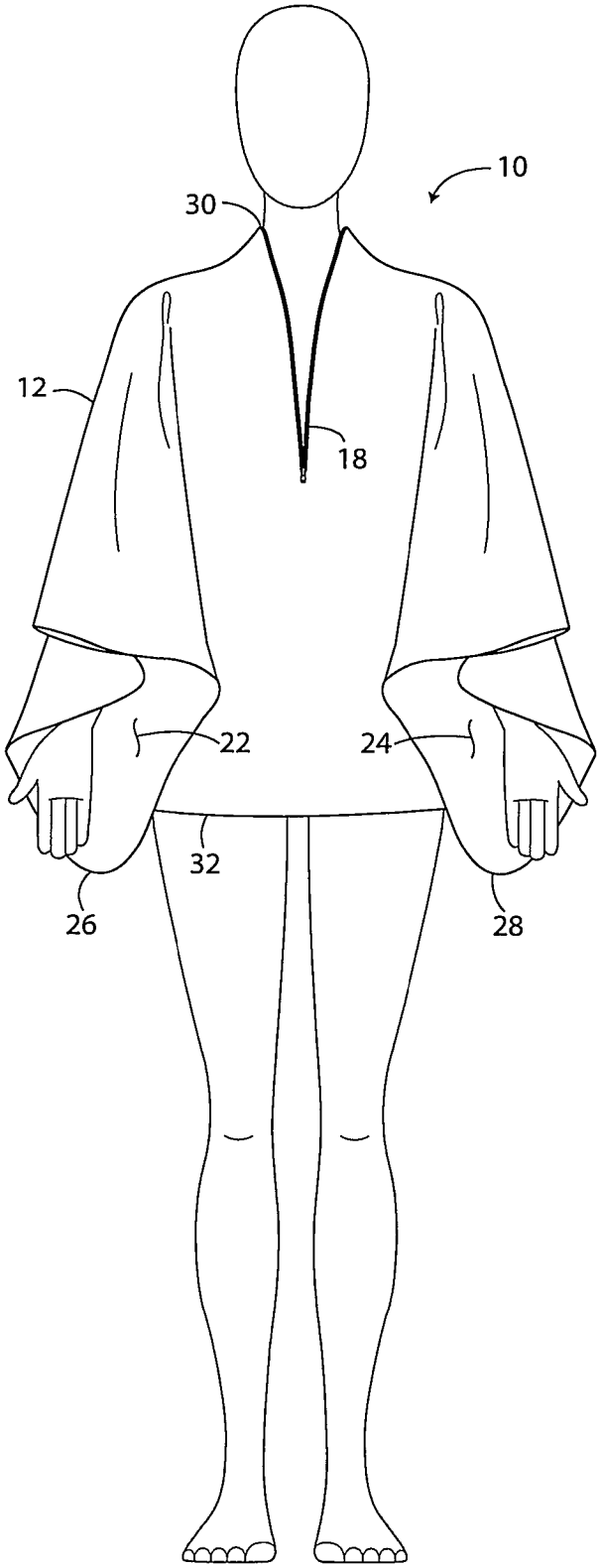
FIG. 3 is a front view of the garment of FIG. 1 being worn by a user in a shirt configuration.

The flexible tube 12 is adapted to be worn in an arm covering configuration. The arm covering configuration encompasses a shirt configuration and a shawl configuration. An example of the flexible tube 12 being worn in the shirt configuration of the arm covering configuration is shown in FIG. 3. As shown in FIG. 3, a portion of the right arm of the user is in the flexible tube 12 adjacent the first end 22 and a portion of the left arm of the user is in the tube adjacent the second end 24. Additionally, as shown in FIG. 3, at least a portion of a torso of the user is in the flexible tube 12. Preferably, when worn in the shirt configuration of the arm covering configuration, a portion of a user's neck extends from the first aperture 30 and a portion of the user's waist extends from the second aperture 32. A person of ordinary skill in the art will understand that the flexible tube 12 can be rotated when it is worn in the shirt configuration of the arm covering configuration. For example, the flexible tube can be rotated such that a portion of the right arm of the user is in the flexible tube adjacent the second end and a portion of the left arm is in the flexible tube adjacent the first end when worn in the shirt configuration of the arm covering configuration.

Figure 4:
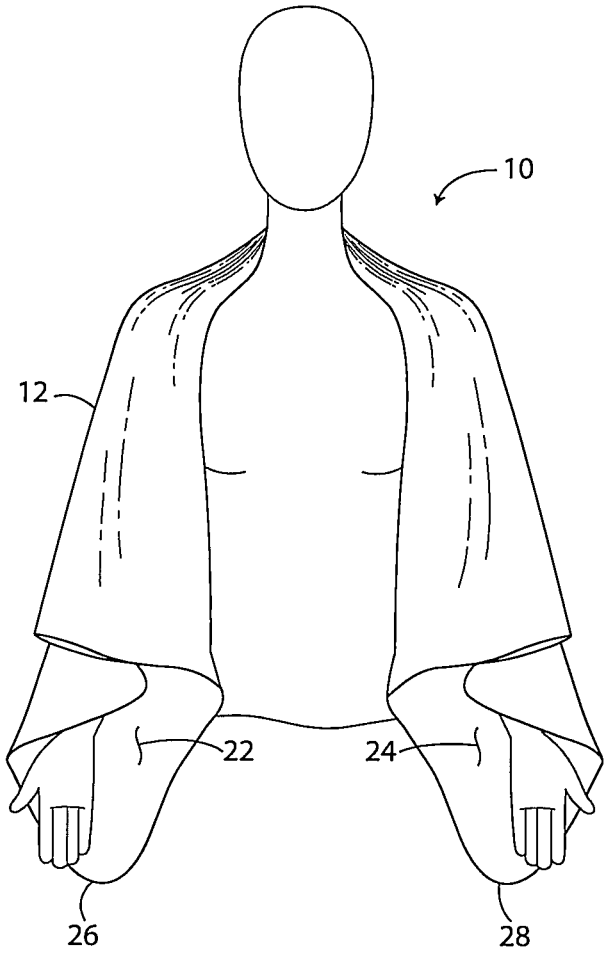
FIG. 4 is a front view of the garment of FIG. 1 being worn by a user in a shawl configuration.

An example of the flexible tube 12 being worn in the shawl configuration of the arm covering configuration is shown in FIG. 4. As shown in FIG. 4, a portion of the right arm of the user is in the flexible tube 12 adjacent the first end 22 and a portion of the left arm of the user is in the tube adjacent the second end 24. Unlike the shirt configuration, however, the torso of the user is outside of the flexible tube 12. A person of ordinary skill in the art will understand that the flexible tube can be rotated when it is worn in the shawl configuration of the arm covering configuration such that a portion of the right arm of the user is in the flexible tube adjacent the second end and a portion of the left arm is in the flexible tube adjacent the first end.

Figure 5:
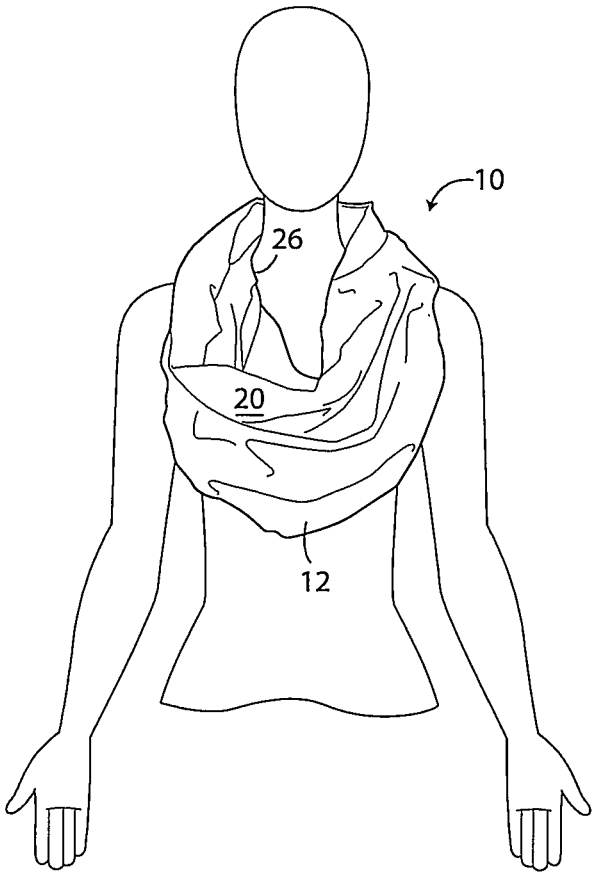
FIG. 5 is a front view of the garment of FIG. 1 being worn by a user in a scarf configuration.

The flexible tube 12 is also preferably adapted to be worn in a scarf configuration. An example of the flexible tube 12 being worn in the scarf configuration is shown in FIG. 5. A portion of the neck of the user is in the flexible tube 12 and the second end 28 of the tube lies on a shoulder region of the user. Additionally, as shown in FIG. 5, a portion of the neck of the user extends from the first end 26 of the flexible tube 12. A person of ordinary skill in the art will understand that the flexible tube 12 can be rotated when it is worn in the scarf configuration. For example, the flexible tube can be rotated such that when it is worn in the scarf configuration, the first end of the tube lies on a shoulder region of the user and a portion of the neck of the user extends from the second end of the flexible tube.

Figure 6:
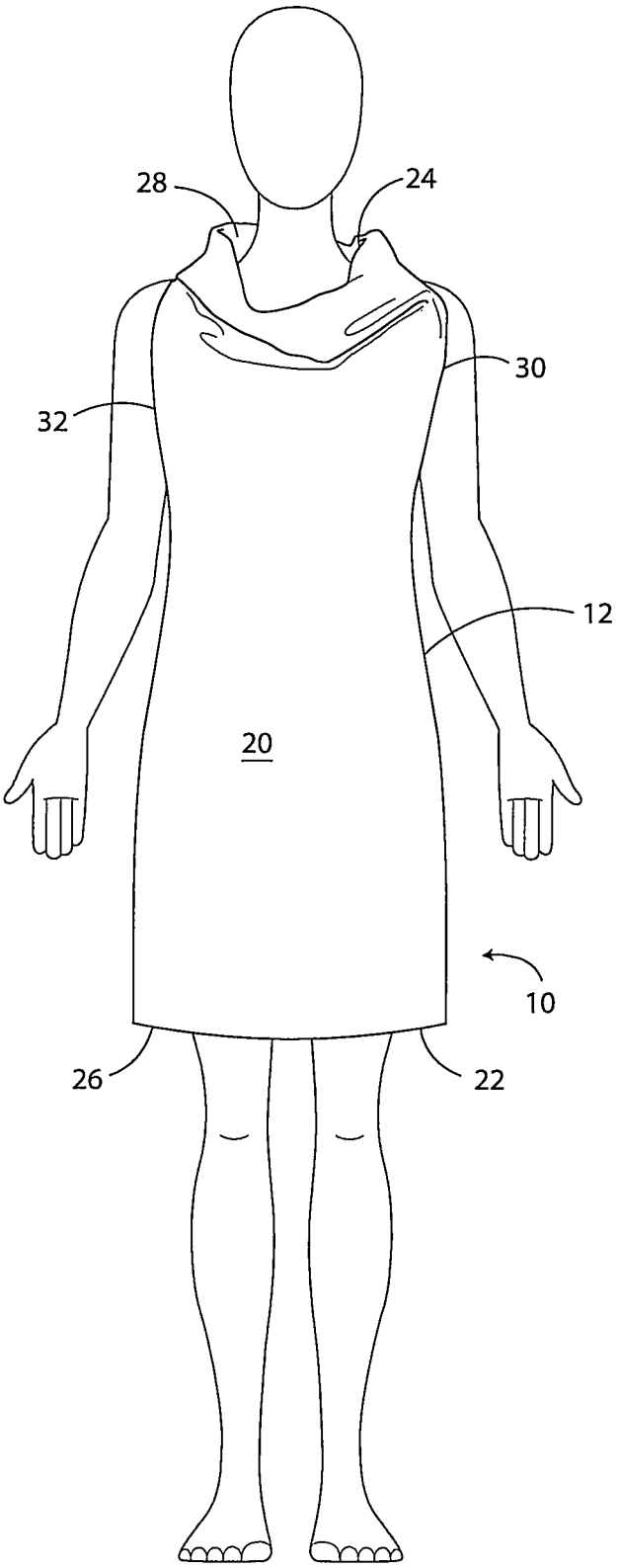
FIG. 6 is a front view of the garment of FIG. 1 being worn by a user in a first dress configuration.

The flexible tube 12 is also preferably adapted to be worn in a first dress configuration. An example of the flexible tube 12 being worn in the first dress configuration is shown in FIG. 6. As shown in FIG. 6, a neck portion of the user is in the tube adjacent the second end 28 and a leg portion of the user is in the tube adjacent the first end 26. Additionally, a portion of a right arm of the user passes through the second aperture 32 and a portion of a left arm of the user passes through the first aperture 30. A person of ordinary skill in the art will understand that the flexible tube can be rotated when worn in the first dress configuration. For example, the flexible tube can be rotated such that when it is worn in the first dress configuration, a portion of a right arm of the user passes through the second aperture and a portion of a left arm of the user passes through the first aperture.

Figure 7:
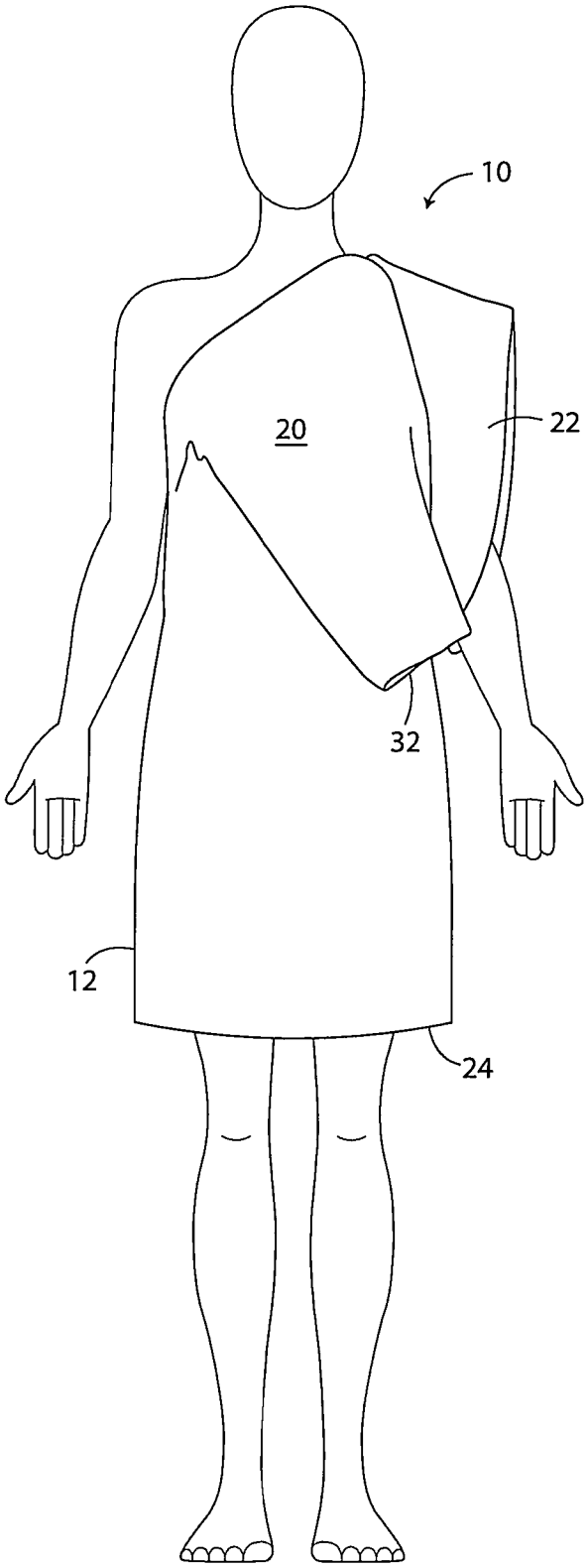
FIG. 7 is a front view of the garment of FIG. 1 being worn by a user in a second dress configuration.

The flexible tube 12 is also preferably adapted to be worn in a second dress configuration. An example of the flexible tube 12 being worn in the second dress configuration is shown in FIG. 7. As shown in FIG. 7, a leg portion, a torso portion, and a left shoulder of the user are in the flexible tube 12 while a right shoulder of the user is outside of the flexible tube. As shown in FIG. 7, the leg portion of the user extends from the second opening 24, the user's left arm extends through the first opening 22, and the user's right shoulder extends from the first aperture 30. A person of ordinary skill in the art will understand that the flexible tube 12 can be rotated when it is worn in the second dress configuration. For example, the flexible tube can be rotated such that when it is worn in the second dress configuration, a right shoulder of a user is inside of the tube and a left shoulder of the user is outside of the tube.

Figure 8:
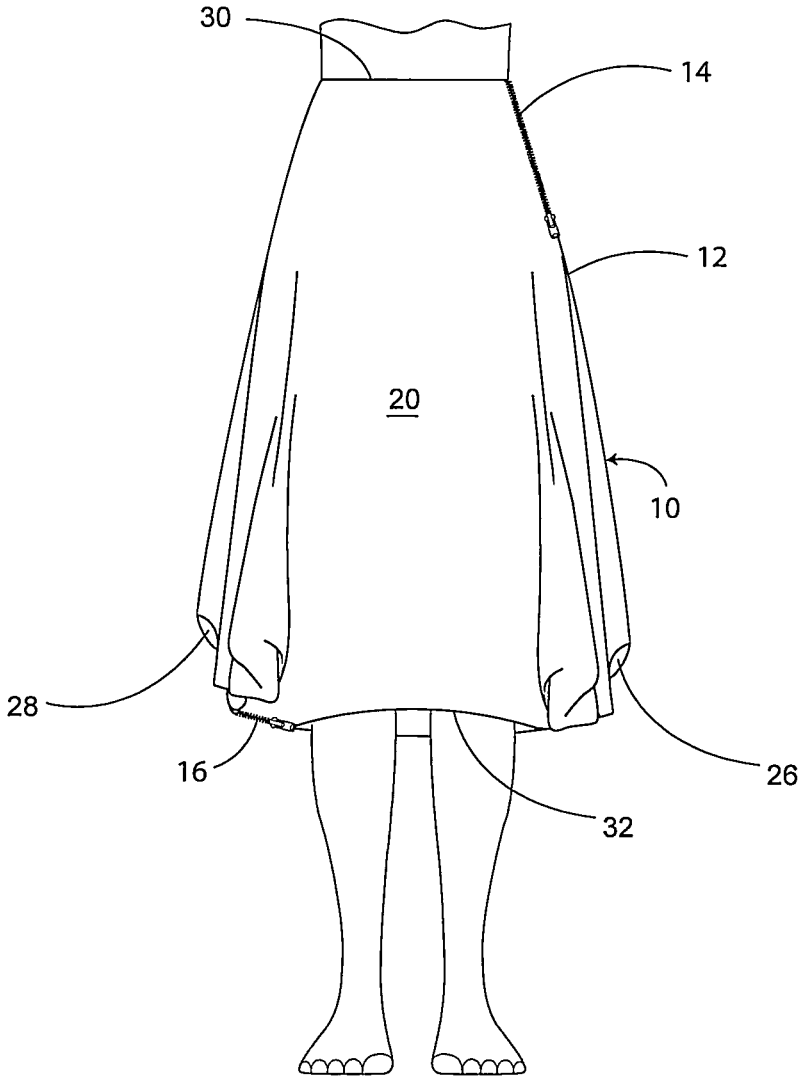
FIG. 8 is a front view of the garment of FIG. 1 being worn by a user in a skirt configuration.

The flexible tube 12 is also preferably adapted to be worn in a skirt configuration. An example of the flexible tube 12 being worn in the skirt configuration is shown in FIG. 8. As shown in FIG. 8, the legs of a user pass through both the first and second apertures 30, 32 when the flexible tube 12 is worn in the skirt configuration. Moreover, a waist portion of the user is located adjacent the first aperture 30 of the flexible tube when the flexible tube 12 is worn in the skirt configuration. The first fastener mechanism 14 enables the effective length of the first aperture 30 to be varied such that the first aperture fits tightly around the waist portion of the user. A person of ordinary skill in the art will understand that the flexible tube can be rotated when it is worn in the skirt configuration such that a waist portion of the user is located adjacent the second aperture of the flexible tube. Moreover, a person of ordinary skill in the art will understand that the flexible tube can be rotated when it is worn in the skirt configuration such that a waist portion of the user is located adjacent one of the first and second openings.

A person of ordinary skill will understand that a user is able to transform the garment 10 from one of the arm-covering configuration, the scarf configuration, the first dress configuration, the second dress configuration, and the skirt configuration to another one of the arm-covering configuration, the scarf configuration, the first dress configuration, the second dress configuration, and the skirt configuration by rotating the garment and/or by adjusting the first, second, and third fastener mechanisms.

Figure 9:
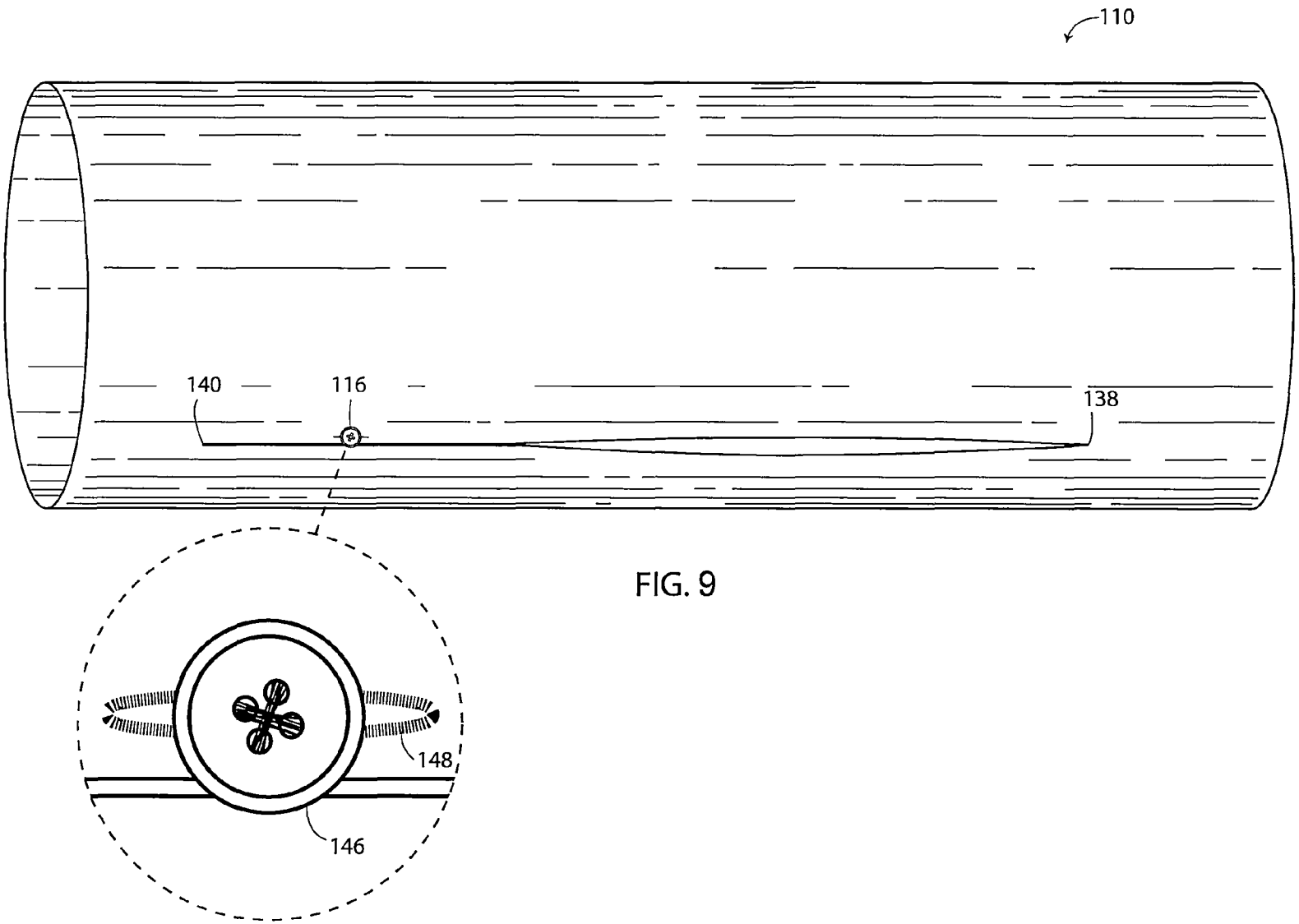
FIG. 9 is an isometric view of another embodiment of a garment transformable among a plurality of configurations.

Referring to FIG. 9, another embodiment of a transformable garment is generally indicated by the reference number 110. Except as noted herein, the embodiment of FIG. 9 is similar to the embodiment of FIGS. 1-8 and the above description concerning the embodiment of FIGS. 1-8 applies to the embodiment of FIG. 9. In the embodiment of FIG. 9, the second fastener mechanism 116 comprises a button 146 and a button hole 148. The button 146 and the button hole 148 are located between the third and fourth aperture points 138, 140, respectively. It is to be understood that additional or different types of fasteners may be used for the first and second fastener mechanisms including, but not limited to, a plurality of buttons, Velcro, hook and eye fasteners, and snaps. Additionally, it is to be understood that the first fastener mechanism could be the same type of fastener as the second fastener mechanism or of a different type of fastener.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A garment transformable among two or more configurations, the garment comprising:

a flexible tube comprising a tube wall extending generally along a longitudinal axis, the tube wall defining first and second openings at opposite first and second ends of the tube, the tube wall comprising first and second apertures, the first aperture having a first maximum length extending generally longitudinally from a first aperture point to a second aperture point, the second aperture having a second maximum length extending from a third aperture point to a fourth aperture point, the first aperture being laterally spaced from the second aperture, at least a portion of the first aperture being located circumferentially opposite a portion of the second aperture; and a fastener mechanism at least partially located between the first and second aperture points and adapted to adjustably close at least a portion of the first aperture to vary an effective length of the first aperture;

the flexible tube being adapted to be worn by a user in an arm-covering configuration wherein at least a portion of one arm of the user is in the tube adjacent the first end and at least a portion of another arm of the user is in the tube adjacent the second end.

2. The garment of claim 1 wherein the flexible tube is adapted such that at least a portion of a torso of the user is in the tube when the garment is worn by the user in the arm-covering configuration.

3. The garment of claim 1 wherein the flexible tube is adapted to be worn by a user in a scarf configuration wherein a portion of a neck of the user is in the tube and at least one of the first and second ends of the tube lies on a shoulder region of the user.

4. The garment of claim 3 wherein the flexible tube is adapted such to be worn by a user in a first dress configuration wherein at least a neck portion of the user is in the tube adjacent one of the first and second ends and at least a leg portion of the user is in the tube adjacent a different one of the first and second ends.

5. The garment of claim 4 wherein the flexible tube is adapted such that at least a portion of one arm of the user passes through one of the first and second apertures and at least a portion of another arm passes through a different one of the first and second apertures when the garment is worn by the user in the first dress configuration.

6. The garment of claim 4 wherein the flexible tube is adapted to be worn by a user in a second dress configuration wherein a leg portion, a torso portion, and one shoulder of the user are in the tube, and another shoulder of the user is outside of the tube.

7. The garment of claim 3 wherein the flexible tube is adapted to be worn by a user in a second dress configuration wherein a leg portion, a torso portion, and one shoulder of the user are in the tube, and another shoulder of the user is outside of the tube.

8. The garment of claim 1 wherein the flexible tube is adapted to be worn by a user in a first dress configuration wherein at least a neck portion of the user is in the tube adjacent one of the first and second ends and at least a leg portion of the user is in the tube adjacent the other of said first and second ends.

9. The garment of claim 8 wherein the flexible tube is adapted such that at least a portion of one arm of the user passes through one of the first and second apertures and at least a portion of another arm passes through the other of said first and second apertures when the garment is worn by the user in the first dress configuration.

10. The garment of claim 8 wherein the flexible tube is adapted to be worn by a user in a second dress configuration wherein a leg portion, a torso portion, and one shoulder of the user are in the tube, and another shoulder of the user is outside of the tube.

11. The garment of claim 1 wherein the flexible tube is adapted to be worn by a user in a second dress configuration wherein a leg portion, a torso portion, and one shoulder of the user are in the tube, and another shoulder of the user is outside of the tube.

12. The garment of claim 1 wherein the flexible tube is adapted to be worn by a user in a skirt configuration wherein the first aperture is adjacent a waist of the user and the legs of a user extend from the second aperture.

13. The garment of claim 1 wherein the flexible tube is made of an elastic fabric, and each of the first and second apertures are slits.

14. The garment of claim 1 wherein the fastener mechanism comprises at least one button and at least one corresponding button hole.

15. The garment of claim 1 wherein the fastener mechanism comprises a zipper.

16. The garment of claim 1 wherein the fastener mechanism is a first fastener mechanism and the garment comprises a second fastener mechanism, the second fastener mechanism is at least partially located between the third and fourth aperture points and is adapted to adjustably close at least a portion of the second aperture to vary an effective length of the second aperture.

17. The garment of claim 16 wherein the garment comprises a third fastener mechanism, the third fastener mechanism is adjacent to one of the first and second apertures and is spaced from the first and second fastener mechanisms, the third fastener mechanism is adapted to adjustably close a portion of said one of the first and second apertures to vary an effective width of said one of the first and second apertures.

18. The garment of claim 1 wherein the first aperture point is between the second aperture point and the second end of the flexible tube, and the third aperture point is between the fourth aperture point and the second end of the flexible tube.

19. The garment of claim 18 wherein the first fastener mechanism is located closer to the second end of the tube than the first end of the tube, and the second fastener mechanism is located closer to the first end of the tube than the second end of tube.

20. The garment of claim 1 wherein the garment has an overall length and an overall width, the overall length generally extending axially along the longitudinal axis and the overall width generally extending perpendicular to the longitudinal axis, a ratio of the overall length to the overall width is greater than 1.

* * * * *